United States Patent [19]

Dieterlen et al.

[11] 4,344,269

[45] Aug. 17, 1982

[54] POUCH FORMING AND FILLING MECHANISM WITH PROVISION FOR INCREASING THE CAPACITY OF THE POUCHES

[75] Inventors: Paul E. Dieterlen, Covington, Ky.; Harold T. Benner, Jr., Cincinnati, Ohio

[73] Assignee: R. A. Jones & Co. Inc., Covington, Ky.

[21] Appl. No.: 169,944

[22] Filed: Jul. 18, 1980

Related U.S. Application Data

[62] Division of Ser. No. 914,426, Jun. 12, 1978, Pat. No. 4,232,504.

[51] Int. Cl.[3] ..... B65B 1/06; B65B 1/24

[52] U.S. Cl. ..... 53/459; 53/455; 53/469

[58] Field of Search ..... 53/459, 468, 469, 473, 53/477, 562, 568, 558, 570, 266, 289, 525, 526, 455

[56] References Cited

U.S. PATENT DOCUMENTS

| | | | |
|---|---|---|---|
| 2,817,936 | 12/1957 | Peterson | 53/525 |
| 2,885,846 | 5/1959 | Harker | 53/562 X |
| 3,371,461 | 3/1968 | Aronson | 53/525 X |
| 3,453,799 | 7/1969 | Cloud et al. | 53/562 |
| 3,488,915 | 1/1970 | Delestatius | 53/525 X |
| 3,667,188 | 6/1972 | Benner, Jr. et al. | 53/455 |
| 3,821,873 | 7/1974 | Benner, Jr. et al. | 53/525 |

*Primary Examiner*—Horace M. Culver

*Attorney, Agent, or Firm*—Wood, Herron & Evans

[57] ABSTRACT

Pouching apparatus for increasing the volume of material packed into a pouch. The apparatus includes a filler wheel assembly, means for rotating said assembly, a vacuum transfer wheel mounted below said filler wheel assembly and rotatable therewith, a plurality of vertical lands circumferentially spaced around said transfer wheel to receive a web of pouches, means for applying vacuum to said lands, a plurality of tuck fingers movably mounted on the transfer wheel between said lands, a stationary, circumferential cam mounted adjacent said transfer wheel to raise said tuck fingers to form an upward tuck in the bottom of each pouch of said web thereby increasing its capacity. The apparatus also includes clips to hold the web on the lands of the transfer wheel. The apparatus also includes a feed roll which feeds said web onto said transfer wheel at a preselected speed somewhat greater than the speed of said transfer wheel to force pouches into the space between said lands. The apparatus further includes means providing one or more jets of air to open the pouches prior to filling.

2 Claims, 11 Drawing Figures

POUCH FORMING AND FILLING MECHANISM WITH PROVISION FOR INCREASING THE CAPACITY OF THE POUCHES

This is a division of application Ser. No. 914,426, filed June 12, 1978, now U.S. Pat. No. 4,232,504.

This invention relates to pouch filling, and more particularly, the invention relates to apparatus for increasing the volume of material with which each pouch can be filled.

Pouch filling apparatus generally is designed to form a pouch, open at the top, from a web of material such as plastic film, paper, or paper lined with film or foil. The pouches are filled with a particulate material, usually a food product such as sugar, soft drink mixes and the like. Thereafter, the pouch is sealed across the top. While the invention will be described hereinafter in relation to the filling of pouches with particulate material, it is to be understood that the invention is also applicable to filling pouches with a liquid.

In some pouch forming and filling apparatus, pouches are formed, separated from a web into individual pouches, filled and sealed. In other apparatus, to which the present invention is more particularly directed, a web of the pouch forming material is formed into a U-shape and is transversely sealed to form individual pouches which are open at the top. The thus formed web is fed onto a transfer wheel and there the pouches are opened and filled. After leaving the transfer wheel, the pouches are sealed across the top and thereafter cut into individual pouches. One such pouch forming apparatus is disclosed in U.S. Pat. No. 3,344,576.

An objective of the present invention has been to provide improvements in the pouch forming and filling apparatus wherein the pouches are capable of being filled with a greater volume of material than has been heretofore possible. One prior art approach to solving this problem has been to create a gusseted pouch which, by the nature of the gusseted configuration, is capable of receiving a greater volume of material than a plain or conventional pouch.

In the present invention, the objective has been to provide a substantial increase in the volume of material which a conventional pouch, that is, a pouch without the specially formed gussets, can hold.

This objective is achieved in accordance with the present invention partly by providing a system of tuck fingers mounted around the perimeter of the transfer wheel around which the web passes and by providing cam means for raising the tuck fingers against the bottom edge of each pouch in a web prior to and during the filling of the pouches.

The engagement of the tuck fingers with the bottoms of the pouches and the raising of the tuck fingers to elevate the central portion of the bottom of each pouch permits a substantial reduction of pouch width as, for example, up to about 33% so that it approaches having a cylindrical configuration during filling as contrasted to the flat configuration during the formation of the pouches. This approach toward the creation of a cylindrical configuration in each pouch greatly increases the volume of material which can be introduced into the pouch. For example, increasing the volume of material by 75% has been found to be possible and it appears that increasing the volume of material up to 100% is theoretically possible.

A prior suggestion of the use of rods to engage the bottom of pouches to increase their capacity is disclosed in U.S. Pat. No. 3,667,188. There the rods contact the pouch bottom only momentarily and at a point well ahead of the filling station. In contrast, the present invention provides for engagement of the pouches ahead of the filling operation and the maintaining of the tuck fingers in engagement with the pouches during the filling operation. Two advantages are derived from this structure and operation. First, by maintaining the tuck fingers in engagement with the pouches there is an assurance that the tucked bottom of the pouch will not collapse and revert to its original configuration before the pouch gets to the filling station. Second, the fingers provide a support for the pouch on the lands during the filling operation.

Another feature of the invention resides in the provision of a feed roll about which the web passes as the web is fed directly onto the transfer wheel. The surface speed of the feed roll is slightly greater than the surface speed of the transfer wheel lands so that an excess of pouch web is fed onto the transfer wheel, the excess being driven into the space between the vertical lands on the transfer wheel. The drive to the feed roll includes a slip clutch by which a uniform torque is maintained on the feed roll. The overdriven feed roll, coupled with the drive on a registration roll, permits a variation in pouch width which can be filled on the transfer wheel, within a limited range of sizes. For example, by feeding a greater or lesser amount of web into the space between the lands, wider or narrower pouches can be filled on the same transfer wheel. The transfer wheel and filler assembly can, for example, run a first product into a four inch wide pouch and can run a different product into a different size pouch. Thus, the packager of the particulate material can be provided with a machine capable of packaging different types of products in different sizes of pouches with a minimum effort required for changeover. Further, there is a potential saving in paper cost to the manufacturer, not only arising out of his ability to package a greater volume in a given size pouch, but additionally through his ability to precisely size the pouch to a given volume of product.

An overdriven feed roll has been employed in apparatus of the type disclosed in U.S. Pat. No. 3,344,576 to provide a reduction in pouch width of up to about 5%, but not higher, with consistent results. The present invention, utilizing the tuck finger assist, has permitted reduction in pouch width by about 22% with consistent results. Theoretically, it is possible to reduce width by about 33% to provide a cylindrical pouch.

Another feature of the invention resides in the capability of changing the radial position of the lands on the transfer wheel thereby providing still further capability of accommodating pouches of different sizes.

As another feature of the invention there is provided cam-actuated clips which cooperate with the lands on the transfer wheel so as to clamp the lower portion of the transverse seal on either side of the pouch against the lands. The clamping clip feature is of importance in connection with the filling of relatively stiff pouches as, for example, pouches which are formed from foil-lined paper, and particularly pouches which have a seal across the bottom. There is a tendency of such pouches to form an imperfect tuck at the bottom or to slide up on the lands when engaged by the tuck fingers. By clamping the pouches against the lands, the problems arising out of the stiffness of material or the pouch configuration are obviated.

Still another feature of the invention resides in the provision of a multiple air jet system for first partially opening the pouch with a small jet of air, then finally opening the pouch with a large volume of air.

Whereas in prior pouch filling apparatus of the type described it has been found desirable to provide a lip at the mouth of the pouch against which a blast of air could be directed in order to assure opening, it has been found that the combination of the manner in which the web flexes around the feed roll and the air jets eliminates the need for the lip. The elimination of the lip, which performs no function after the pouch is filled, results in still further saving in pouch forming material and a more attractive pouch.

The several objectives and features of the invention will become more readily apparent from the following detailed description taken in conjunction with the accompanying drawings in which:

FIG. 3 is a cross-sectional view through the transfer wheel;

Figure 1A:
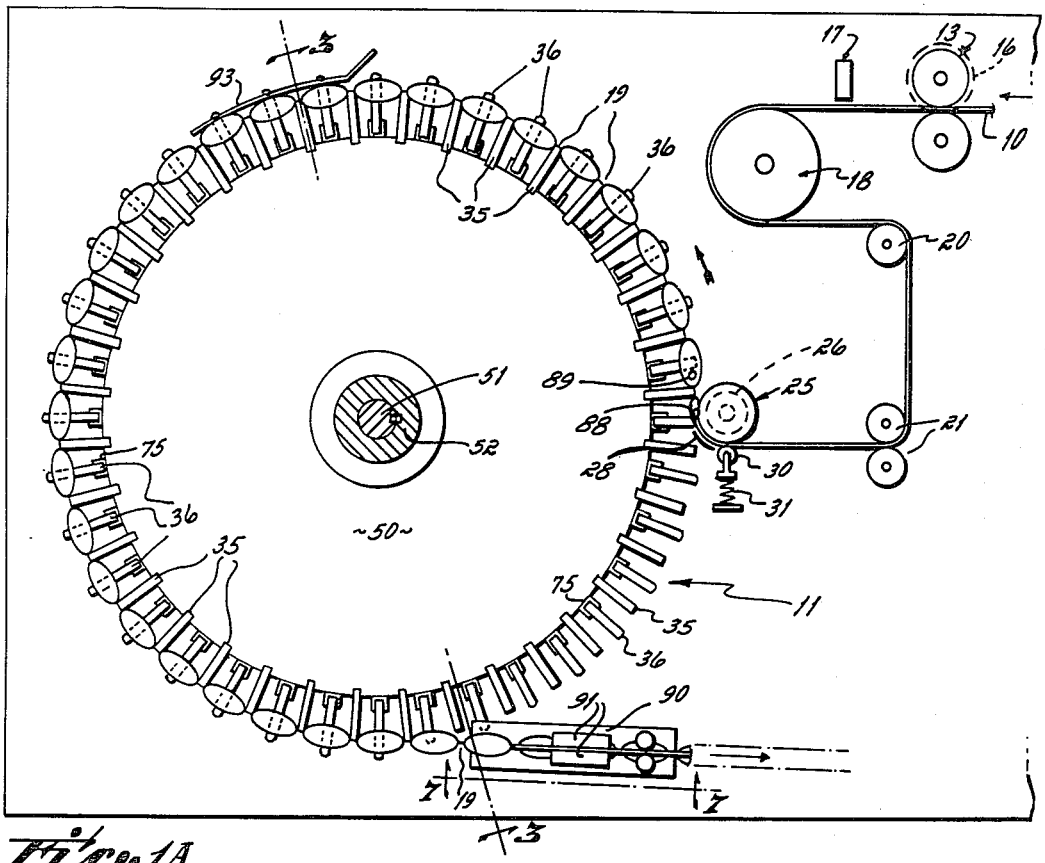
FIG. 1A is a diagrammatic plan view of the transfer wheel and associated mechanism for feeding the web to it.

Referring particularly to FIG. 1A, a web 10 is illustrated as being fed toward a transfer wheel 11. The web is first folded longitudinally by a folding mechanism such as is described in U.S. Pat. No. 3,398,656. The thus folded web passes between a pair of registration rolls 13 driven by a variable speed drive 16.

The registration rolls have been illustrated as being downstream of the folding mechanism, but they can perform satisfactorily if located on the upstream side of the folding mechanism. The web passes by a photoelectric system 17 which reads registration marks on the web and controls the drive for the registration rolls 13 in order to feed the web properly onto the transfer wheel 11 with transverse seals aligned with the lands. The web then passes around a vertical sealer 18 having heated lands as described in U.S. Pat. No. 3,344,576. During the excursion around the vertical sealer, the contact of the web with the heated lands creates longitudinally-spaced vertical or transverse seals 19 across the web. For this purpose the web has an internal film of thermoplastic material capable of being fused by the heated lands in order to create the transverse seals. The transverse seals define individual, although interconnected, pouches in the web.

One of the registration rolls is driven by a V-belt passing over a spring-loaded pulley. If the belt is driven at a constant speed, increased tension on the belt spreads the pulley apart, thereby permitting the belt to drive a reduced diameter and consequently drive the registration roll at a higher speed.

The web passes by the photoelectric system 17 which reads registration marks at the location of each transverse seal. Another electric eye, on the machine, provides electrical pulses timed to the machine speed. A control system monitors the pulses from the two electric eyes. If the control system determines that the web is beginning to lag with respect to the sealer, means are provided to apply greater tension to the belt which in turn causes the registration roll to speed up, thereby permitting the web to catch up to the sealer. If the web starts to lead the sealer, on the other hand, the control system applies less tension to the belt to correct that situation.

Following the sealing, the web passes around idler rolls 20, 21, one of which may be driven. From the idler rolls 21, the web passes around a feed roll 25. The feed roll may be provided with holes around its circumference connected to a vacuum source in order to securely grip the web 10 as it passes around the feed roll. Preferably, however, the feed roll is simply rubber-coated, the rubber providing a sufficient friction grip on the web to function satisfactorily. The feed roll 25 preferably engages the web above the bottom of the web leaving about one inch of the bottom of the web free from engagement by the feed roll. This lower overhang of the web with respect to the feed roll appears to improve the capability of the bottom of the web ballooning out as it moves onto the transfer wheel.

Figure 4:
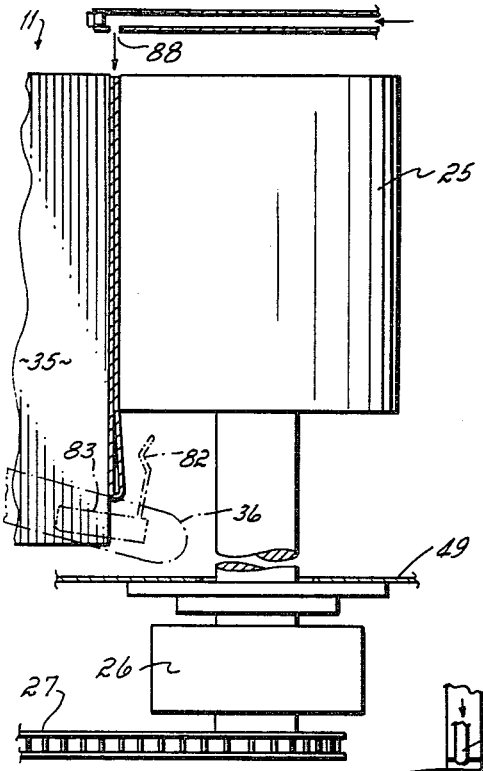
FIG. 4 is a side elevational view taken along lines 4—4 of FIG. 1C.
Figure 6:
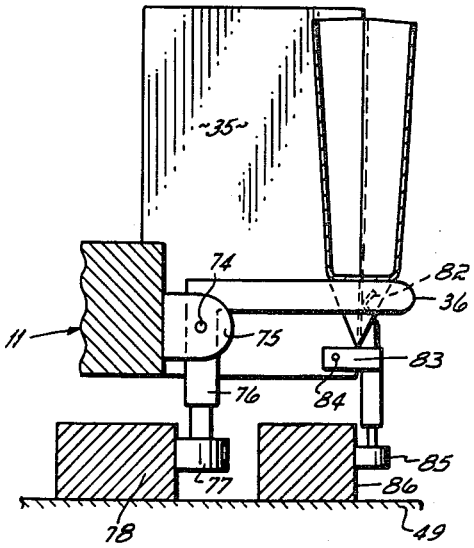
FIG. 6 is a fragmentary cross-sectional view illustrating the raised position of the tuck fingers and clamping clip.

The feed roll is connected by a slip clutch 26 (FIG. 4) to a drive 27. The drive 27 is a part of the main drive for the pouching apparatus so that the feed roll is driven synchronously with the transfer wheel 11. The slip clutch which reduces the speed of the feed roll from the input speed of the drive 27 by about one to thirty percent maintains a uniform tension on the web as it is fed onto the transfer wheel.

The speed of the surface of the feed roll 25 is slightly greater than the speed of the surface defined by the lands of the transfer wheel so as to force the web into the space between the lands on the transfer wheel. A spring steel finger 28 may be mounted adjacent the feed roll and in engagement with the upper portion of the web to prevent the pouches from opening until they pass between the line of centers between the feed roll and transfer wheel. A pressure roll 30 is urged by a compression spring 31 toward the feed roll and securely clamps the web against the feed roll to minimize slippage.

The transfer wheel 11 has a plurality of substantially vertical lands 35 uniformly spaced around the periphery of the wheel. For some applications, the lands may be inclined. A tuck finger 36, to be described more fully below, is located midway between each pair of adjacent lands.

It is contemplated that the apparatus be adapted to accommodate webs having different pouch widths, that is, the transverse seals would be on different centers but adapted for filling on the same transfer wheel without changing the spacing of the lands 35. For example, a pouch which is approximately four inches wide can be run on the same transfer wheel with width variations in the range of $\frac{3}{4}$ inch. This change can be effected by replacing the vertical sealer 18 with one having its sealing lands on the new centers. Additionally, the variable speed drive 16 to the registration roll is altered slightly in order to match the feed of the web to the new spacing of the lands on the sealer. The slip clutch 26 on the feed roll has a sufficient range of slip to continue to apply a uniform tension to the web as it is fed onto the transfer wheel even though the different rate of feeding of the web causes the feed roll to rotate at a different rpm. If the range of the slip clutch is not sufficient to accommodate the changed speed of the feed roll, a feed roll of a different diameter can be used.

The structure of the transfer wheel which is associated with a filling head 40 is best illustrated in FIG. 3. The filling mechanism 40 is diagrammatically illustrated and may be of the type disclosed, for example, in U.S. Pat. No. 3,563,001. The function of the filling mechanism is to deliver a charge of particulate material to each of the spouts 41 which are uniformly spaced around the perimeter of the transfer wheel and are located above the space between each pair of adjacent lands 35.

The spouts 41 are mounted on a plate 42 which is rotatably mounted by bearings 43 on an inclined shaft 44. As the plate 42 rotates with respect to the inclined shaft, the filler spouts 41 will rise above the lands 35 during the time that the web is being fed onto the transfer wheel. In another portion of the excursion around the circumference of the apparatus, the inclined shaft 44 causes the plate 42 to lower the filler spouts into the space between the lands and into the opened pouches. While in the open pouches, the filler mechanism 40 causes a measured charge of material to be introduced into each pouch through the filler spouts.

The transfer wheel, mounted below the filler mechanism, is supported on a fixed plate 49 on which a rotatable plate 50, forming a part of the transfer wheel 11, is mounted. The transfer wheel is keyed to a shaft 51 which passes through a sleeve 52 connected by bolts 53 to the plate 50. The sleeve 52 has notches 54 circumferentially spaced around sleeve 56 in its upper end. Each notch 54 receives a roller 55 mounted on the lower end of a sleeve 56 which surrounds the shaft 44. The rollers 55 provide the driving connection between the sleeve 52 and the filler mechanism as the filler mechanism rotates around the inclined shaft 44.

Means, preferably vacuum, are provided for holding the web on the lands. Each land 35 is fixed to the perimeter of the plate 50. Each land has a vertical bore 60 which is plugged by a screw 61 at its upper end, the vertical bore being connected to a horizontal bore 62. Projecting outwardly from the bore 60 are four radial bores 63 which provide a vacuum grip on the transverse seals of the web. Vacuum is applied to the lands through a radial bore 64 in the plate 50, the radial bore being connected to a vacuum source 65 which is threaded into an annular block 66 secured to the fixed plate 49. The block 66 has a channel 67 extending around approximately 270° of the circumference of the block 66. The channel begins at about the point that the feed roll 25 drives the web onto the lands (3 o'clock position on FIG. 1A) and extends counterclockwise around to approximately the 6 o'clock position on FIG. 1A where the pouches leave the transfer wheel.

A sealing or wear ring 68 is fixed to the rotatable plate 50 and bears on the annular block 66. The sealing plate has a port 69 connected to each bore 64 of each land and forms the communication between the channel and the bore 64.

The face of each land is covered with a soft, resilient strip 70 such as vinyl which has four channels 71 in its face, the channels communicating with the radial ports 63.

The lands may be removed and replaced with lands having a different radial dimension in order to adapt the apparatus to pouches having substantially different widths from those illustrated.

A plurality of tuck fingers 36 are mounted around the perimeter of the plate 50 intermediate adjacent lands 35. Each tuck finger is pivoted at 74 to a bracket 75 mounted on the edge of the plate 50. The pivot axis 74 is located below the axis of the tuck finger about one-half the distance between the point where the finger first engages a pouch and the final upper position of the finger. The tuck finger has a depending arm 76 carrying a roller 77 at its lower end. The roller 77 rides on a circumferential cam 78 fixed to the fixed plate 49 by bolts 79. While the profile of the cam is not illustrated, it should be understood that it has a relatively steep slope extending from about the 3 o'clock position as viewed in FIG. 1A counterclockwise for about 10° so as to cause the tuck finger 36 to swing upwardly and fully up into the bottom of a pouch in about 15° after the pouch has engaged the transfer wheel. Instead of providing a roller follower to connect the tuck fingers to the cam, the connection can be made simply by locating the cam under the fingers and configurating the upper surface of the cam to cause the fingers to raise and lower. The profile of the cam should be such as to maintain the tuck finger in a raised position at least through the filling of each pouch. Filling occurs during approximately the excursion between the 1 o'clock and 10 o'clock positions of the pouch as viewed in FIG. 1A. Thereafter, the cam is profiled to permit the tuck fingers to disengage from the bottom of the pouch.

By pivoting the tuck finger below the axis of the finger, the point of the finger which engages the pouch initially will slide radially outwardly on the pouch as the finger swings up, and midway in the upward movement of the fingers the point of engagement will move radially inwardly, thereby minimizing the stress on the bottom of the pouch.

In FIGS. 1–7, the tuck finger 36 is shown as a simple cylindrical finger which is about ½ inch in diameter. For some applications, it may be desirable to increase the lateral dimension of the finger by mounting a curved plate **36*a* on the end of the finger for engagement with the bottom of the pouch. It has been found that for large pouches of approximately 4 inches width, a curved plate having a radius of approximately 2½ inches, as shown in FIG. 8**, tends to eliminate undesirable wrinkling of the pouch when the pouch is engaged by the tuck finger.

A spring clamping clip 82 is mounted on an L-shaped arm 83 which is pivoted at 84 to a land. The lower end of the arm has a roller 85 which rides against a vertical cam 86 extending around the circumference of the fixed plate 49. The clip is only necessary for pouches whose structure is such that it is hard to form the tuck in the bottom as, for example, in the pouches made of very stiff material and particularly when the pouches have a seal across the bottom. The cam for the clamping fingers therefore is configurated to thrust the clip against the pouch which has been fed onto the transfer wheel as soon as it contacts a land. And the clip should remain in place at least until the tuck finger has reached its maximum elevation into the bottom of the pouch which, as indicated above, is after about 15° of travel away from the feed roll 25. For some applications, the clip may be used alone, without the vacuum, to hold the web in proper position on the lands.

Alternatively, the clip could be designed normally to remain in clamping position with cams used only to release the clip, as, for example, at the 5 o'clock and 3 o'clock positions shown in FIG. 1A.

Figure 1B:
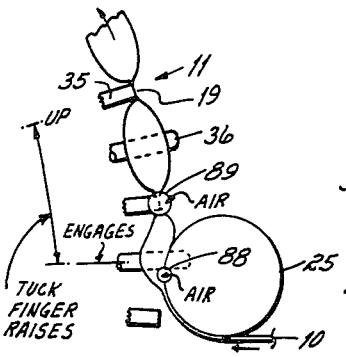
FIGS. 1B and 1C are fragmentary, diagrammatic, top plan views illustrating the sequence of positions of a web as it moves onto the transfer wheel.
Figure 1C:
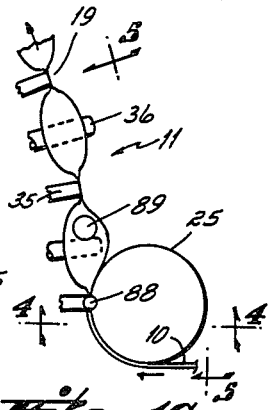
Figure 5:
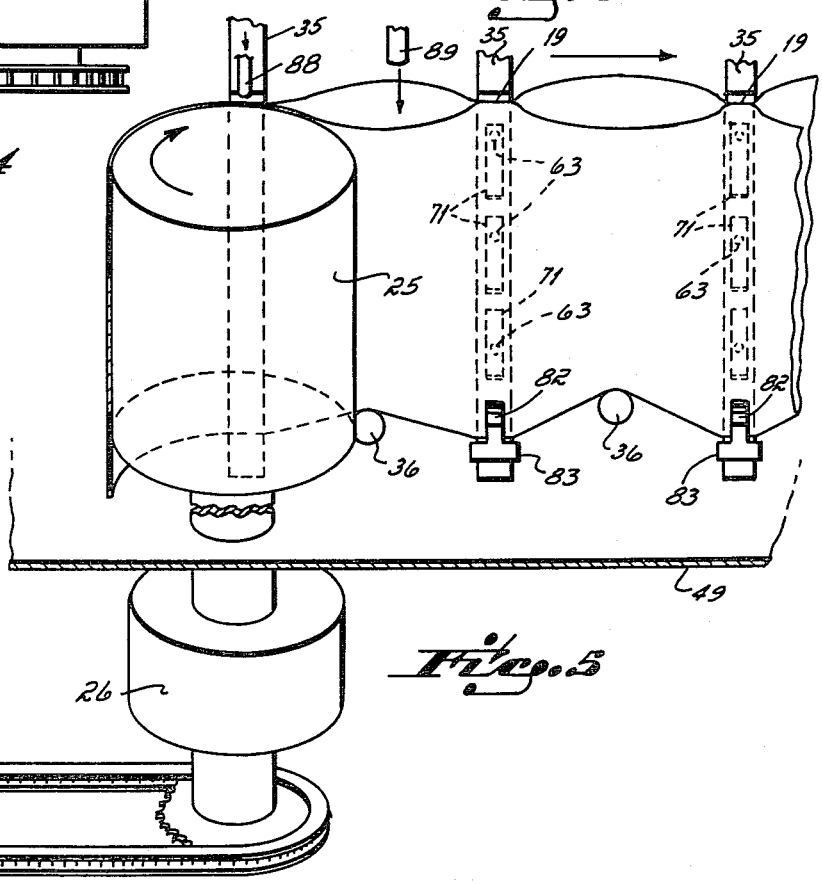
FIG. 5 is a side elevational view taken along lines 5—5 of FIG. 1C looking at about a 15° angle into a poucher.

In order to open the pouches, two nozzles are provided to direct blasts of air downwardly into the unsealed top of the pouch (FIGS. 1 and 5). The first nozzle 88 is located just a degree or so counterclockwise from the feed roll 25. The second nozzle 89 is located about the distance between the lands counterclockwise from the first nozzle. The positions of the nozzles are preferably adjustable in order to obtain the best results for different speeds and/or different types of pouches.

The first nozzle has an opening of about ⅛ inch, sufficient to begin the opening of the pouch. The second nozzle has a larger opening, for example, ¼ inch diameter, to provide sufficient air to fill the pouch during the brief time that the pouch passes underneath the nozzle. Improved results are obtained if the airstream from the second nozzle can be flattened out as by using an oblong hole (directed along the width of the pouch) in the nozzle or, alternatively, to direct the flow of air across a plate before it reaches the pouch.

The combination of the manner in which the feed roll frictionally drives the web onto the transfer wheel, coupled with the two air jets for a first opening and then a pouch filling with air, provides assurance that even the hard-to-open pouches are opened satisfactorily.

Figure 7:
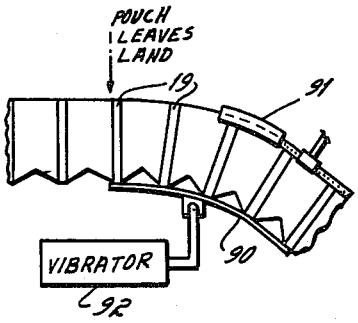
FIG. 7 is a fragmentary side elevational view of the sealer taken along lines 7—7 of FIG. 1A.
Figure 8:
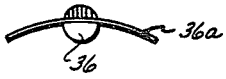
FIG. 8 is a diagrammatic end elevational view of an alternative form of tuck finger.
Figure 2:
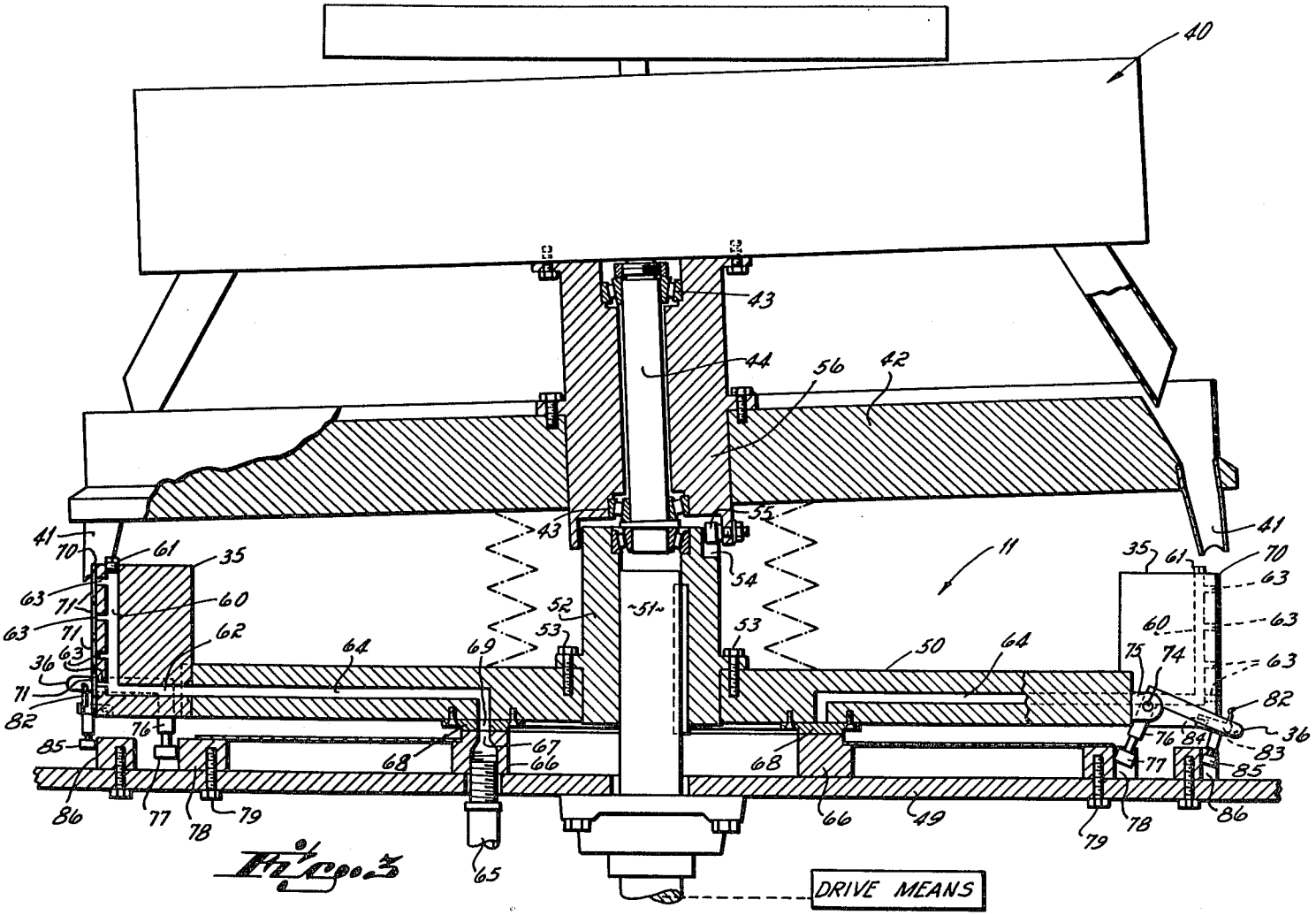

Downstream of the transfer apparatus is a sealer shown in FIG. 7. The sealer has a curved plate 90 over which the web of now filled pouches passes. In passing the web over the curved plate, the upper portion of the pouches (which are open) is stretched out in order to bring the two lips of the pouch together. The upper portion of the pouches is fed past a heated sealer bar 91 to effect the sealing of the pouches. Optionally, a vibrator 92 may be attached to the plate 90 in order to effect a settling of the particular material in the pouches, thereby providing greater head room at the top of the pouches to facilitate the sealing.

Figure 2A:
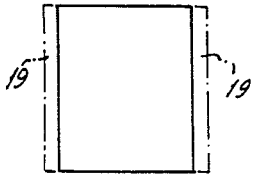
FIG. 2A illustrates a pouch width before it has been opened.

In the operation of the invention, a web is folded and passed around the vertical sealer 18 where transverse seals 19 are formed. A representative pouch width at that stage is illustrated at FIG. 2A. The web is then passed around the idler rolls and around feed roll 25 where it is driven by the higher surface speed of the feed roll into the spaces between the lands 35 of the filler wheel.

Figure 2B:
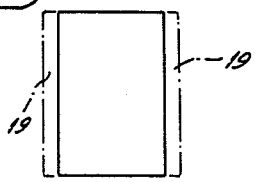
FIG. 2B illustrates the pouch width after it is mounted on the transfer wheel lands and opened.

The pouch width, when a pouch is shoved between the lands, is reduced as illustrated in FIG. 2B. This reduction in width is accompanied by the opening of the pouch toward a circular cross-section.

In the first 10° of travel of the web around the transfer wheel, several things happen. First, a first jet of air from nozzle 88 begins the opening of the pouch just as it leaves the feed roll. Then the second larger jet of air fills the pouch and opens it completely.

In the meantime, the tuck fingers are cammed upwardly into the bottom portion of the pouch in order to form the tuck and enlarge the bottom area of the pouch into a more circular configuration.

Where clamping clips are employed, the clamping clips are moved into engagement with the sealed transverse seals of the pouches, clamping them against the outer surface of the lands so that as the tuck fingers move upwardly, the web is prevented from sliding upwardly along the lands.

Vacuum is also applied to the lands, which vacuum remains applied until the land reaches approximately the 6 o'clock position as viewed in FIG. 1A. Thereafter, a blast of air is applied to free the web from the lands. The vacuum is usually sufficient to hold the web on the lands even without the assistance of the clamping clips.

As soon as the pouches are open, and at about the 2 o'clock position as viewed in FIG. 1A, the filling spout 41 begins to enter the pouch. The orientation of the shaft 44 around which the plate 42 and filling spout 41 pass is such that the maximum outer or upper position of the spout is at about the 5 o'clock position as viewed in FIG. 1A and the point of maximum insertion into the pouch is at about the 11 o'clock position.

The rotation of the transfer wheel carries the web counterclockwise as viewed in FIG. 1A. At about the 1 o'clock position, the filling process begins and is concluded at about the 10 o'clock position. During this period, a metered charge of particulate material flows by gravity into the pouches. Optionally, a spring strip 93 may be employed simply to rub against the pouches as they are being filled in order to assist in shaking the product down into the bottom of the pouches. Also, the tuck fingers could be vibrated at this point (during and after the filling sequence) to help settle the product.

The pouches continue to be carried counterclockwise by the transfer wheel and at about the 8 o'clock position of the filler spout leaves the pouch. The web is withdrawn from the transfer wheel at about the 6 o'clock position and immediately passes into the sealer mechanism illustrated in FIG. 7. There, the mouths of the pouches are sealed and the web of pouches passes through a cutting mechanism of the type illustrated in U.S. Pat. No. 3,597,898.

Having described our invention, we claim:

1. The method of filling a flexible pouch which has sealed lateral edges, a closed bottom and an open top, comprising the steps of, supporting the lateral edges of the pouch in a generally vertical attitude, reducing the width of the pouch by moving the lateral edges toward each other, applying a force to the bottom of the pouch to form a tuck therein, maintaining said force against the bottom of said pouch to hold the tuck in the pouch, and filling the pouch while said force is maintained against the bottom of said pouch in the bottom of the pouch.

2. The method as in claim 1 in which a plurality of said flexible pouches are preliminarily formed as a web in edge-to-edge relation, the tuck forming and pouch filling steps being performed while said pouches are in web form.

* * * * *